United States Patent [19]

Alkhato

[11] Patent Number: 4,951,344

[45] Date of Patent: Aug. 28, 1990

[54] BEVERAGE CAN CLEANING DEVICE

[76] Inventor: Youbert Alkhato, 6192 Cahalan Ave., San Jose, Calif. 95123

[21] Appl. No.: 225,243

[22] Filed: Jul. 28, 1988

[51] Int. Cl.[5] ..... A47L 25/00; A47L 17/00

[52] U.S. Cl. ..... 15/257 R; 15/104 R; 15/210 R; 15/268

[58] Field of Search ..... 15/160, 210 R, 247, 15/236.07, 236.08, 236.09, 59, 65–67, 70, 75, 164, 104 R, 257 R, 268

[56] References Cited

U.S. PATENT DOCUMENTS

| | | | |
|---|---|---|---|
| 413,168 | 10/1889 | Burt | 15/70 |
| 4,069,537 | 1/1978 | Matsuo | 15/247 X |
| 4,733,423 | 3/1988 | Blatt | 15/104.04 X |
| 4,813,091 | 3/1989 | Glasener | 15/160 |

*Primary Examiner*—Harvey C. Hornsby
*Assistant Examiner*—M. Spisich
*Attorney, Agent, or Firm*—John J. Leavitt

[57] ABSTRACT

Presented is a device for cleaning dirt and debris from the top surface and side surface portions of a beverage can from which the contents are to be drunk directly by placing the mouth on the end of the can surrounding the opening therein. Included is a flange portion that overlaps the side of the can so that a towel sandwiched between the cleaning device and the can wipes away contaminants. Also included is a bead that projects into the groove found on most cans within the rim to thereby press a layer of paper toweling or facial tissue into the groove so that upon rotation of the cleaning device on the end of the can, any contaminants are wiped away, thus preventing them from being entrained with and consumed with the beverage. A concave surface on the cleaning device presses paper towel or facial tissue against the top of the can in the area surrounding where the opening will be formed when the beverage can is opened.

12 Claims, 1 Drawing Sheet

BEVERAGE CAN CLEANING DEVICE

BACKGROUND OF THE INVENTION

1. Field of the Invention.

This invention relates to beverage can cleaning devices, and particularly to a device for cleaning the top and a portion of the side wall of a pop-top type beverage can of the type that enable drinking of the contents of the beverage can directly from the can.

2. Description of the Prior Art.

A search for prior art pertaining to the subject matter to which the invention herein is directed has revealed the existence of the following U.S. Pat. Nos.:

| | | |
|---|---|---|
| 1,258,208 | 1,629,358 | 2,299,089 |
| 2,740,150 | 2,790,193 | 3,378,869 |
| 3,551,937 | 3,604,047 | 3,753,267 |
| | 4,187,574 | |

Of these patents, only U.S. Pat. Nos. 3,551,937 and 3,604,047 appear to pertain to the subject matter to which the instant invention is directed, namely, the cleaning of a portion of a beverage can prior to placing the mouth in contact with the can to drink the beverage directly therefrom.

In years past, beverages, both alcoholic and nonalcoholic "soft" drinks, were packaged in bottles. It was customary to remove the cap from the bottle, and drink the contents directly from the bottle. Some people could be observed wiping the top of the bottle before placing their lips on the bottle, but these were the exception and not the rule.

Then, the time came when beverages, particularly nonalcoholic "soft" drinks, were packaged in cans. Initially, these cans were fabricated from thin sheet steel, and it was necessary to use a can opener, sometimes referred to as a "church key", to punch two oppositely positioned holes in the top of the can from one of which the contents could be poured into a glass or paper cup, or from which the contents could be drunk directly by placing ones mouth directly over one of the punched openings and tipping the can to pour the contents into the mouth.

Still later, the thin sheet steel can gave way to the very thin aluminum can the body of which is formed in one piece and the top of which is a separate circular plate of aluminum formed with a "pop-top" feature that enables forming an opening in the top of the can merely by tugging on or twisting a tab.

It is not generally within the immediately conscious thought processes of a person about to drink directly from a beverage can that has followed a diverse path from the manufacturer to the retail outlet from which the beverage can is purchased. During this diverse path, it can be expected, upon reflection, that the can is exposed to many elements that contaminate the top and sides of the can. Upon giving conscious thought to the problem of cleanliness thus presented, most persons about to drink from a beverage can make some effort to clean the top of the can where they expect to place their mouth. These efforts frequently take the form of using their handkerchief if nothing else is available, or a paper towel or facial tissue if that is available.

Accordingly, one of the primary objects of the invention is the provision of a device that facilitates the cleaning of the top and a side portion of a beverage can prior to drinking directly therefrom.

The formation of the sealed beverage can results in a relatively deep groove being formed in the top of the can next adjacent the rim thereof. Observation has revealed that contaminating dirt and debris of various kinds finds it way into this groove and, unless removed prior to drinking from the can, is entrained with the beverage and therefore consumed along with the beverage. It is therefore another important object of this invention to provide a device that may be manipulated to clean the debris, dirt, and other contaminating substances from the groove.

The opening that is formed in the top of a beverage can prior to drinking directly therefrom is usually adjacent one edge of the can and extends radially for some finite distance toward the center of the top of the can. Accordingly, to drink directly from the can through the opening thus formed, it is necessary that the mouth be placed on the top of the can in such a manner that the upper lip is contiguous with the top of the can surrounding the opening. It is therefore a still further object of the invention to provide a device for cleaning the top of the can in the area surrounding the opening.

In the sealing process of beverage cans, the body of the can, formed into a tubular unit closed at one end, is joined at its open end to the generally flat, preformed top by a swaging operation that seals the top to the tubular body. In so doing, the can body adjacent the top is reduced in diameter and crimped fluid-tight to the top, there resulting a circular indentation or a conical portion adjacent the top. In drinking directly from a can, the lower lip is placed in contact with this reduced in diameter portion of the can adjacent the top. Accordingly, a still further object of the invention is the provision of a device that may be applied to the top of the can in conjunction with a paper towel or facial tissue and which upon rotation relative to the beverage can will wipe clean this reduced diameter area of the can.

A still further object of the invention is the provision of a device for cleaning the top of a beverage can in which the device may be carried on a key chain for ready accessibility.

Still another object of the invention is the provision of a device that may be mounted on a beverage can dispensing machine for ready accessibility by the customers who purchase beverage cans from the machine.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the beverage can cleaning device of the invention comprises a monolithic body formed with an outer peripheral flange the inner surface of which is shaped to conform generally to the configuration of the body of the can adjacent the top thereof. Additionally, the device is formed with a groove adapted to receive the rim of the can formed when the cylindrical body is swaged to the flat top, and includes a bead proportioned and configured to penetrate the groove formed in the top of the can during the swaging process that seals the top of the can to the body of the can. Means are also provided, in conjunction with a paper towel or facial tissue, to clean the area of the top of the can surrounding the opening, whereby all parts of the beverage can that come into contiguous contact with the mouth are wiped clean of any dirt, dust, or other contaminating substances that might be ingested along with the beverage when the beverage is drunk directly from the can.

DESCRIPTION OF THE PREFERRED EMBODIMENT

Figure 1:
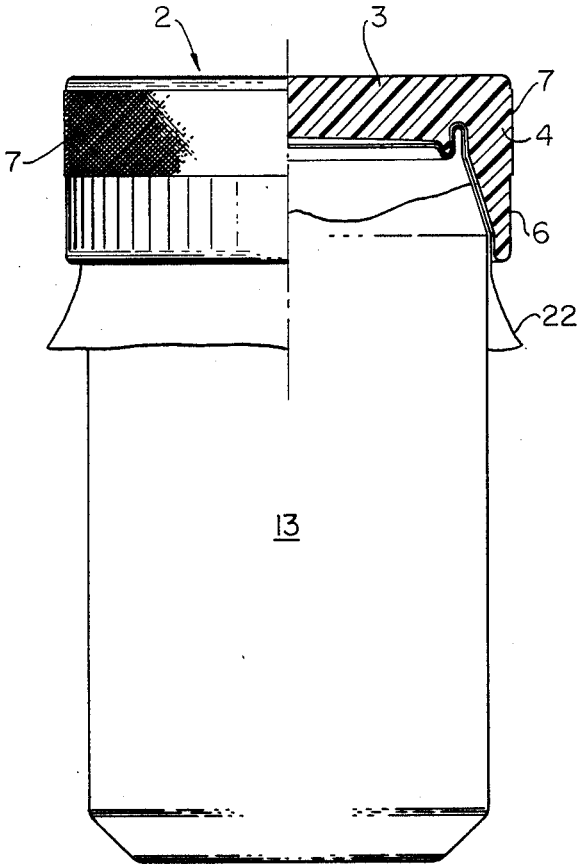
FIG. 1 is a side elevational view of a beverage can having the cleaning device applied thereon, portions of the cleaning device being shown in vertical section to illustrate the cooperative relationship of the cleaning device with the underlying beverage can.
Figure 2:
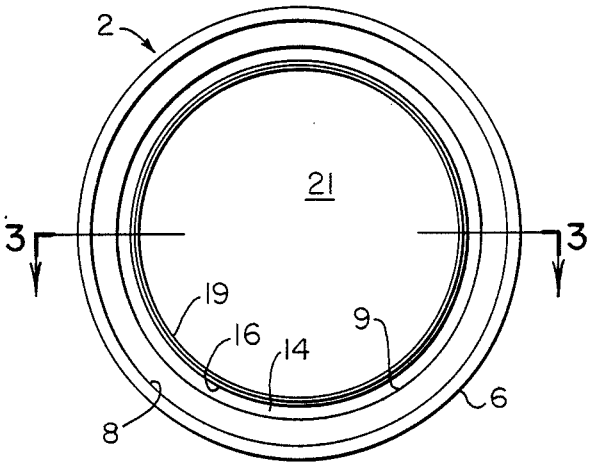
FIG. 2 is a bottom plan view of the structure illustrated in FIG. 1.

In terms of greater detail, the beverage can cleaning device of the invention is designated generally by the numeral 2 in the accompanying drawings. In the embodiment illustrated in FIGS. 1, 2, 3 and 6, the device comprises a generally circular cup-shaped monolithic body 3, formed with an outer peripheral flange 4, having an outer peripheral surface 6, a portion 7 of which surface is knurled as illustrated, to facilitate digital manipulation of the device.

The inner periphery of the flange 4 is provided with a cylindrical surface portion 8 adjacent the free end of the flange 4, while at the root of the flange adjacent the body portion 3, the flange is provided with a second cylindrical surface 9, of somewhat smaller diameter than the surface 8. Both these cylindrical surfaces 8 and 9 merge smoothly and integrally with an intervening conical surface 12 as shown that conforms closely to the exterior configuration of the associated beverage can 13.

The cylindrical surface 9 of the flange 4 forms one side wall of the groove 14, the other side wall of the groove being formed by the a cylindrical wall 16, a continuation 17 of which forms the outer periphery of a cylindrical bead 18 having an inner periphery 19 that connects with the inner surface 21 of the body portion 3. As illustrated, the inner surface 21 is preferably formed with a slight concavity to accommodate the crown that most beverage can tops are formed with.

As will be seen from FIG. 1, with the device formed as described, to clean the top of a beverage can prior to opening the can, a paper towel or tissue 22 is draped over the top of the can and the cleaning device is placed over the towel or tissue and only slight pressure applied. The cleaning device is then rotated as many times as is required to completely clean and wipe away all debris and dirt from the top of the can. The cleaning device and towel are then removed and upon inspection it will be found that the top of the can is now clean and free of all debris and dirt, thus presenting beverage can surfaces with respect to which there is no reluctance to place the mouth or lips for the purpose of drinking direct from the can.

Figure 6:
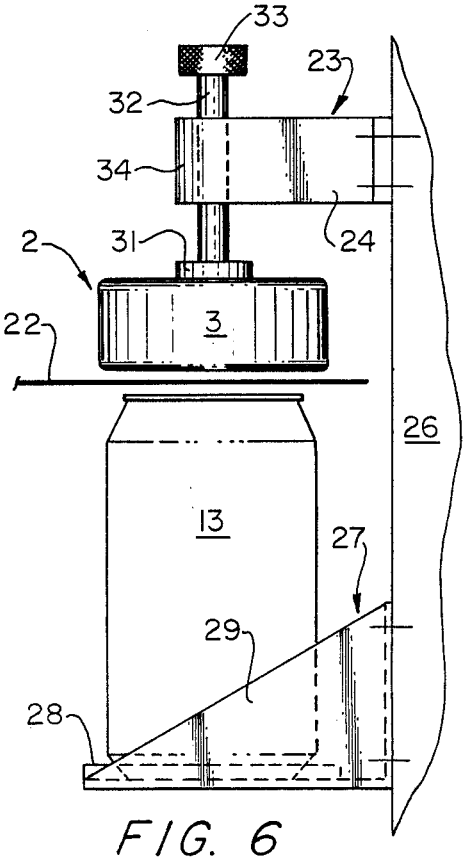
FIG. 6 is illustrates the embodiment of FIG. 1 mounted on a support structure to make the cleaning device a permanent attachment for use where beverage cans are dispensed.

In the embodiment of the invention illustrated in FIGS. 1, 2, 3 and 6, the cleaning device body 3 is completely circular as illustrated and can be held easily in one hand while the can is held by the other hand while the cleaning device is depressed and rotated. Thus, the device illustrated in these views may conveniently be carried in the glove compartment of an automobile, for instance, or even in a purse, where it is readily accessible for use. I understand however that many people will not want to carry such a device. Accordingly, the embodiment of FIG. 6 provides a fixed support designated generally by the numeral 23 and comprising a cantilever arm 24 secured to a wall 26 which may be a wall portion of the machine from which the beverage cans are dispensed. To support the beverage can, there is provided a bracket 27, also attached to the wall 26, but below the cantilever arm a sufficent distance to receive thereon a beverage can as illustrated. The bracket includes a platform 28 on which the can is supported, and side walls 29 to lend a degree of rigidity to the bracket. As illustrated, the cleaning device 2 is secured to the enlarged lower head 31 of the shaft 32, which is also provided with an upper head 33. The shaft 32 is rotatably and slidably mounted in the bearing portion 34 of the cantilever arm to permit elevation of the cleaning device for placement of the towel 22 between the cleaning device and the top of the can as illustrated.

Figure 4:
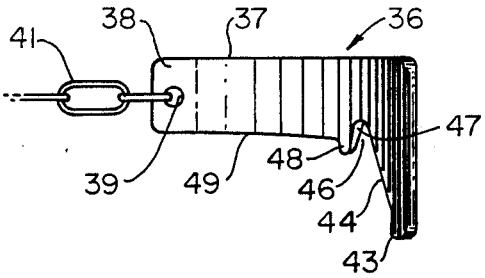
FIG. 4 is a side elevational view of a second embodiment of the invention, embodied in a form that may be attached to a key chain.
Figure 5:
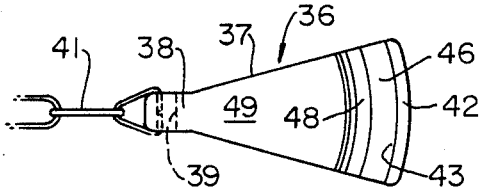
FIG. 5 is a bottom plan view of the structure illustrated in FIG. 4.

The embodiment of the cleaning device forming the subject matter of this invention as illustrated in FIGS. 4 and 5 is particularly useful for being carried in the pocket, or a purse, and attached to a key chain for ready accessibility. In this embodiment the cleaning device is designated generally by the numeral 36, and includes a triangular body portion 37, the apex end 38 of which is provided with an aperture 39 to which is attached a chain 41.

Figure 3:
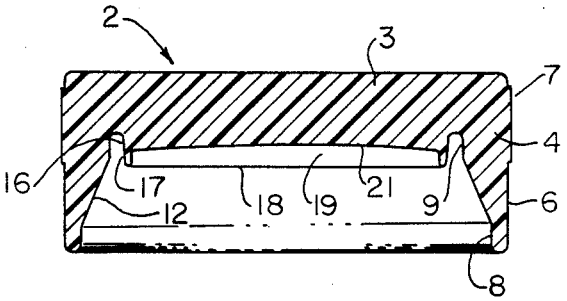
FIG. 3 is a vertical cross-sectional view taken in the plane indicated by the line 3—3 in FIG. 2.

At its opposite end, the triangular body portion 37 is arcuate, being a portion of a circle, and is formed with an arcuate flange 42 having an inner peripheral cylindrical surface portion 43 equivalent to the cylindrical surface 8 of the device as illustrated in FIG. 3. The cylindrical surface 43 merges with the conical surface 44 that extends into the body of the device to form one wall of the groove 46 the other wall 47 of which is continued to form the bead 48 which projects beyond the inner surface 49 of the body 37. It will thus be seen that all that is required to use the cleaning device is to place a paper towel or facial tissue on the top of the can to be cleaned, place the cleaning device over the towel so that the flange 42 projects over one edge of the can and the body 37 is superimposed over the towel and top of the can. A slight amount of pressure on the device will cause the bead 48 to press the towel material into the groove in the can, while the sloping or conical surface 44 of the flange will press the towel material against the outside surface of the can, so that rotation of the cleaning device when so held on the can results in all of the dirt, debris, or other contaminants being wiped from the can prior to opening. After opening, the mouth may be placed on the can so as to surround the opening without concern that the top of the can is dirty and contaminated.

Having thus described the invention, what is believed to be new and novel, and sought to be protected by letters patent of the U.S. is as follows.

I claim:

1. A device operable to facilitate cleaning the exterior end including the exterior top, rim and exterior side wall portions of a pop-top type beverage can which may be expected to be placed in direct contact with the mouth by a person who drinks directly from the can, comprising:

(a) a monolithic body adapted to be superimposed in contiguous relationship on the exterior end of a beverage can on which it is intended to place the mouth to drink the contents of the can;

(b) a peripheral flange portion on the monolithic body having inner and outer surfaces, at least a portion of said inner surface conforming to the configuration of the exterior side wall of a beverage can adjacent the top wall and rim thereof;

(c) a groove formed in said monolithic body and adapted to receive at least a portion of the rim of a beverage can when said monolithic body is placed on the exterior end of the beverage can;

(d) a bead integrally formed on said monolithic body and projecting substantially parallel to said peripheral flange portion and configured to extend into the bight between the beverage can rim and said beverage can top surface; and (e) a surface on said monolithic body conforming to the configuration of said top wall, such when paper toweling or a facial tissue is spread over the end of said beverage can and said monolithic body is superimposed over the toweling thereon, said paper toweling or facial tissue lies sandwiched between said monolithic body and said beverage can, rotation and of said monolithic body relative to said beverage can effects cleaning of the exterior end portion of the side wall of the can, said rim and said top wall, whereby visible contaminants are wiped from the beverage can by said toweling or facial tissue.

2. The combination according to claim 1, in which said monolithic body is formed from a synthetic resinous material.

3. The combination according to claim 1, in which said peripheral flange portion on the monolithic body is circularly arcuate in configuration.

4. The combination according to claim 1, in which said peripheral flange portion on the monolithic body is circular in configuration.

5. The combination according to claim 1, in which said groove formed in said monolithic body is circularly arcuate in configuration.

6. The combination according to claim 1, in which said groove formed in said monolithic body is circular in configuration.

7. The combination according to claim 1, in which said bead on said monolithic body is circularly arcuate in configuration.

8. The combination according to claim 1, in which said bead on said monolithic body is circular in configuration.

9. The combination according to claim 1, in which said surface on said monolithic body conforming to the top wall of the beverage can is concave in configuration.

10. The combination according to claim 1, in which means are provided for supporting said monolithic body rotatably and slidably in relation to a closed and sealed beverage can, and means are provided for supporting a closed and sealed beverage can in position to be engaged by said monolithic body, said means supporting said monolithic body including a shaft secured to said monolithic body and a cantilever arm including a bearing portion in which the shaft is rotatably and slidably mounted, said means for supporting said closed and sealed beverage can including a bracket fixed in relation to said cantilever arm whereby the beverage can supported on said bracket may be engaged by said monolithic body to effect cleaning of the top surface of said beverage can.

11. The combination according to claim 10, in which said cantilever arm and said bracket are mounted on a common support means,and said shaft is coaxilly arranged on said monolithic body.

12. The combination according to claim which said bracket includes a platform on which said closed and sealed beverage can may be supported in coaxial alignment with said monolithic body and said shaft, a mounting plate, and spaced wall plates connecting the platform to said mounting plate to rigidify the structure.

* * * * *